US007146949B2

(12) United States Patent
Mendler

(10) Patent No.: US 7,146,949 B2
(45) Date of Patent: Dec. 12, 2006

(54) VALVE CONTROL APPARATUS

(76) Inventor: Edward Charles Mendler, 7 Millside La., Mill Valley, CA (US) 94941

( * ) Notice: Subject to any disclaimer, the term of this patent is extended or adjusted under 35 U.S.C. 154(b) by 0 days.

(21) Appl. No.: 10/474,156

(22) PCT Filed: Sep. 14, 2001

(86) PCT No.: PCT/US01/29216

§ 371 (c)(1),
(2), (4) Date: Oct. 1, 2003

(87) PCT Pub. No.: WO02/29214

PCT Pub. Date: Apr. 11, 2002

(65) Prior Publication Data

US 2004/0237918 A1 Dec. 2, 2004

Related U.S. Application Data

(60) Provisional application No. 60/236,149, filed on Sep. 29, 2000.

(51) Int. Cl.
*F01L 1/18* (2006.01)

(52) U.S. Cl. ..... 123/90.39; 123/90.16; 123/90.31; 123/90.4; 123/90.44

(58) Field of Classification Search ..... 123/90.15, 123/90.16, 90.17, 90.27, 90.31, 90.34, 90.39, 123/90.4, 90.41, 90.44, 90.6
See application file for complete search history.

(56) References Cited

U.S. PATENT DOCUMENTS 4,537,165 A * 8/1985 Honda et al. ..... 123/90.16
4,627,391 A * 12/1986 Derringer ..... 123/90.16
4,662,323 A 5/1987 Moriya
4,836,171 A 6/1989 Melde-Tuczai
5,042,438 A 8/1991 Heil et al.
5,065,709 A 11/1991 Ito et al.
5,235,940 A 8/1993 Nakatani et al.
5,445,116 A * 8/1995 Hara ..... 123/90.16
5,456,224 A 10/1995 Riley
5,937,807 A 8/1999 Peters et al.
6,009,842 A 1/2000 Hiereth

FOREIGN PATENT DOCUMENTS

DE 41 04872 A1 2/1991

OTHER PUBLICATIONS

Automotive Engineering International, pp. 106-107, May 2001.

(Continued)

*Primary Examiner*—Thomas Denion
*Assistant Examiner*—Ching Chang

(57) ABSTRACT

A first camshaft (24) operates the exhaust valves (18) and a first intake valve (12) for each cylinder (8), and a second camshaft (38) operates the second intake valve per cylinder (14), the second camshaft further having a phase adjuster (62) for adjusting the timing of the second camshaft (38) relative to the first camshaft (24). Both the exhaust valves and the first intake valve are actuated by rocker arms (30), (36), for providing a short and light-weight first intake valve rocker (36) having a high maximum operational speed capability and low friction. The first camshaft (24) is located above the rockers, the cam followers are located generally in the middle of the rockers (30), (36), and the rocker mounts (33), (35) are located on the inboard ends of the rockers, providing rockers that have both light-weight and a small pivot angle for providing low valve stem to rocker friction.

30 Claims, 8 Drawing Sheets

OTHER PUBLICATIONS

Ward's Auto World, p. 64, Jan. 2001.

High Technology, p. 15, Jun. 1986.

Combustion characteristics of an Otto-Atkinson engine using late inlet valve closing and multi-point electronic fuel injection.

G T O'Flynn, R. J. Saunders, and T. H. Ma; Society of Automotive Engineers paper 925107, pub 1992.

A Design and Experimental Study of an Otto Atkinson Cycle Engine Using Late Intake Valve Closing: S. C. Blakey, R. J. Saunders, and T. H. Ma and A. Chopra; Society of Automotive Engineers paper No. 910451, pub. 1991.

A Survey of Variable-Valve-Actuation Technology: T. Ahmad and M. A. Theobald, Society of Automotive Engineers paper No. 891674, pub. 1989.

* cited by examiner

VALVE CONTROL APPARATUS

PROVISIONAL APPLICATION REFERENCE

This application relates to U.S. Provisional Application No. 60/236,149 having a filing date of Sep. 29, 2000.

BACKGROUND OF THE INVENTION

The present invention relates to a method and apparatus for controlling valves, and more specifically to a method and apparatus for adjusting the timing of internal combustion engine poppet valves.

It has been known for some time that throttling losses contribute significantly to poor engine efficiency at light power levels. In 1958 the Society of Automotive Engineers (SAE) published "Determination of True Engine Friction," SAE Trans., Vol. 66, pp. 649–661 which deals with throttling and aerodynamic pumping losses. Throttling losses remain a significant problem with spark-ignition passenger cars, as the throttle remains the principal method of regulating engine power output.

German automobile manufacturer BMW announced that it has developed a spark ignition engine with no throttle, and having power output controlled by an adjustable valve control apparatus, which is described in Automotive Engineering International, pp. 106, May 2001. According to BMW, the engine will be the first spark-ignited automotive engine ever offered for sale without a throttle. Engine power is controlled by adjusting the lift and timing of the intake valves. A problem with the BMW mechanism is that the intake valves restrict (e.g., throttle) air flow at the intake ports, and as a consequence pumping losses are only partially reduced relative to conventional throttled engines. Another significant problem with the BMW mechanism is that of cost. The system reportedly will increase engine cost by about 15 percent. Another problem with the mechanism is that it increases engine height and cannot be easily packaged into a broad range of automobile makes and models.

R. J. Saunders, T. H. Ma, and others show an Otto Atkinson cycle engine in SAE paper 910451 (pub. 1991) and in IMechE paper 925107 (pub. 1992) which employs adjustable valve timing to control engine power. Specifically, each cylinder has two intake valves, the timing of one of the two valves having an adjustable phase timing to control the time at which the cylinder is sealed and compression started. At light power levels, the phase shifted intake valve is closed late, causing much of the intake air to be pushed back into the intake manifold by the piston before the start of charge compression within the cylinder. The late intake valve closing is effective for controlling engine power and almost fully eliminating throttling and aerodynamic pumping losses.

With regard to the valve control mechanism shown by Saunders et al., each cylinder has two exhaust valves and a first intake valve driven by a first camshaft, a second intake valve driven by a second camshaft, and a phase adjuster for adjusting the phase relationship between the first and second camshafts. The exhaust valves and the second intake valve have inverted bucket type tappets that are driven by the respective camshafts. The first intake valve is driven by a rocker arm that reaches across the cylinder head from the first camshaft to the first intake valve, the first camshaft being located directly above the exhaust valves. The camshaft bearings for the first camshaft are located between the adjacent exhaust valves of each cylinder, and the intake rocker arm cam lobes are located immediately adjacent to one another for adjacent cylinders, providing a total of four cam lobes between some cam bearings. A significant problem with the valve adjustment mechanism is that the rocker arms are long and massive, adversely effecting mechanical friction and engine top end speed. Another problem is that the camshaft is prone to bending, resulting in valve train wear, due to the large cam lobe count between camshaft bearings, and further with the most highly load rocker cam lobes being located mid-span between the bearings. Another problem with the system disclosed by Saunders is that the valve lash will require frequent servicing due to the massive rockers in combination with the assembled multi-piece rocker mounts. In contrast, automotive manufacturers are now producing valve trains that do not require service for 100,000 miles. A further problem with the system disclosed by Saunders is that of cost due to the rocker mount assemblies and due to difficulty in establishing alignment from cylinder to cylinder.

A principal limitation of modern spark-ignition engine power output is that of limited space available for the intake and exhaust ports, resulting in small and non-streamlined ports, resulting in limited airflow into the cylinders and limited exhaust flow out of the cylinders. Additionally, high power output cylinder heads require a greater cooling capacity water jacket above the combustion chamber, which requires additional space. Increasing the outward size of the cylinder head does not substantively improve port size immediately above the valves where flow is most restricted, and adversely effects cylinder head weight and overall size, a small size being important for packaging the engine into the engine bay of the vehicle. In general, space limitations within the cylinder head prevent use of optimum size, shape and placement of the intake and exhaust ports, and also prevents the simultaneous optimum placement of the water jacket, spark tube, valve springs, tappets and/or rockers, camshafts, camshaft bearing caps, bearing cap fasteners, head bolts, and other cylinder head parts.

The problem of compromised cylinder head design resulting from space constraints is exacerbated in engines having two intake valves per cylinder, where one of the two intake valves has an adjustable phase or adjustable timing to control engine power. As one example of the adverse effect of limited space within the cylinder head, in the system described by Saunders et al., space is not available between the intake rocker arms for a single rocker shaft mount, and consequently two rocker shaft mounts are required, the two rocker shaft mounts being more expensive. Additionally, the two rocker shaft mounts occupy the space inboard of the exhaust valves, precluding and/or complicating use of inboard exhaust rockers located between the exhaust and intake valves. Additionally, space is not available between the rockers for a camshaft bearing, and consequently the camshaft is under supported. Further, the cylinder head bolts are located approximately inline with the exhaust camshaft, and largely concealed by the intake rockers.

Accordingly, objectives of the present invention include near-elimination of throttling and aerodynamic pumping losses, large high flow intake and exhaust ports, a high cooling capacity water jacket, no or almost no increase in mechanical friction, a high maximum engine speed capability, no or almost no increase in engine size, high durability and infrequent required service, and a low cost.

SUMMARY OF THE INVENTION

According to the present invention, air flow into and out of an engine is controlled by two intake valves and one or more exhaust valves per cylinder, the timing of the two intake valves being phase shifted to control the amount of air trapped in the cylinder. A first camshaft operates the exhaust valves and one of the intake valves per cylinder, and a second camshaft operates the second intake valve per cylinder. The phase relationship between the first and second camshaft being adjustable by a phase shifter for adjusting the amount of air trapped in the cylinder. According to the present invention, both the first intake valve and the exhaust valves are actuated by rocker arms and a centrally located first camshaft. The individual rocker arms are short and light weight providing low mechanical friction and a high maximum speed capability. The first camshaft is further located above the rockers providing space for the spark tube within a narrow valve included angle. A narrow valve included angle is also used to further minimize rocker length, in order to minimize rocker mass and friction, and maximize top end engine speed capability. According to the preferred embodiment of the present invention, the two exhaust valves are actuated by a single shaft mounted exhaust rocker, and the first intake valve is actuated by a shaft mounted rocker, the intake and exhaust rockers being mounted on the same shaft, the shaft being located generally on the piston side of the first camshaft, providing a very compact package, and also permitting use of a narrow valve included angle and short rockers. The present invention provides phase shifting between adjacent intake valves for near elimination of throttling and aerodynamic pumping losses, and also provides a high maximum operational speed and generous space for streamlined intake and exhaust ports, permitting high engine power levels to be attained. The present invention is also compact and can be packaged into a broad range of automobile makes and models.

According to the preferred embodiment of the present invention, the camshaft bearings are located between the cylinders, thereby providing space within the cylinder head for both intake and exhaust rocker arms, and for providing rigid support of the first camshaft with a minimum number of bearings. In the preferred embodiment of the present invention, a cam bearing is located between each pair of adjacent first intake valve rockers for rigid support of the camshaft in general, and the first intake valve cam lobes in particular. Preferably, a single rocker shaft slides into a hole in the cylinder head for rigidly supporting all of the rockers associated with the first camshaft. The present invention is durable and requires no more frequent servicing than current production engines having shaft mounted rockers due to the rigid support and precise alignment of the camshafts and rockers, and due to the short and light-weight intake and exhaust rockers.

According to the present invention, the axis of rotation of the first camshaft is located between the intake and exhaust valves and the cylinder head bolt tool path axis passes free and clear of the first camshaft bearings, the first camshaft bearings being located approximately on the same axial plain as the cylinder head fastener assembly axis, thereby providing a compact and light weight cylinder head further having undisturbed first camshaft bearings. According to another embodiment of the present invention, the cylinder head bolts may be studs, where the middle bolt head secures the cylinder head to the engine block, and the outer threads are used to secure the cam bearing caps to the cylinder head, thereby providing a compact and light weight cylinder head.

The present invention provides light-weight rocker arms capable of operating at high engine speeds, and with low attendant friction levels. The present invention does not compromise system life or service requirements, and of significant importance the present invention has the same service requirements as modern production engines having shaft-mounted valve rockers. The present invention provides robust bearing support for the camshafts, and the first camshaft bearings are free and clear of the cylinder head bolts. Additionally, the present invention permits application of a narrow valve included angle, beneficial for modern high compression ration engines, and for future production variable compression ratio engines. The spark tube provides direct access to the spark plug, of essential importance, and difficult to achieve with a narrow valve included angle. A very significant benefit of the present invention is that of low cost. The cylinder head parts for the valve control apparatus of the present invention are inexpensive to manufacture, and the parts can be assembled into the cylinder head at low cost. The present invention provides a high engine performance and low friction levels, in addition to phase shifting of the two intake valves per cylinder for engine power control with greatly reduced throttling losses.

DETAILED DESCRIPTION OF THE PREFERRED EMBODIMENTS

Figure 1:
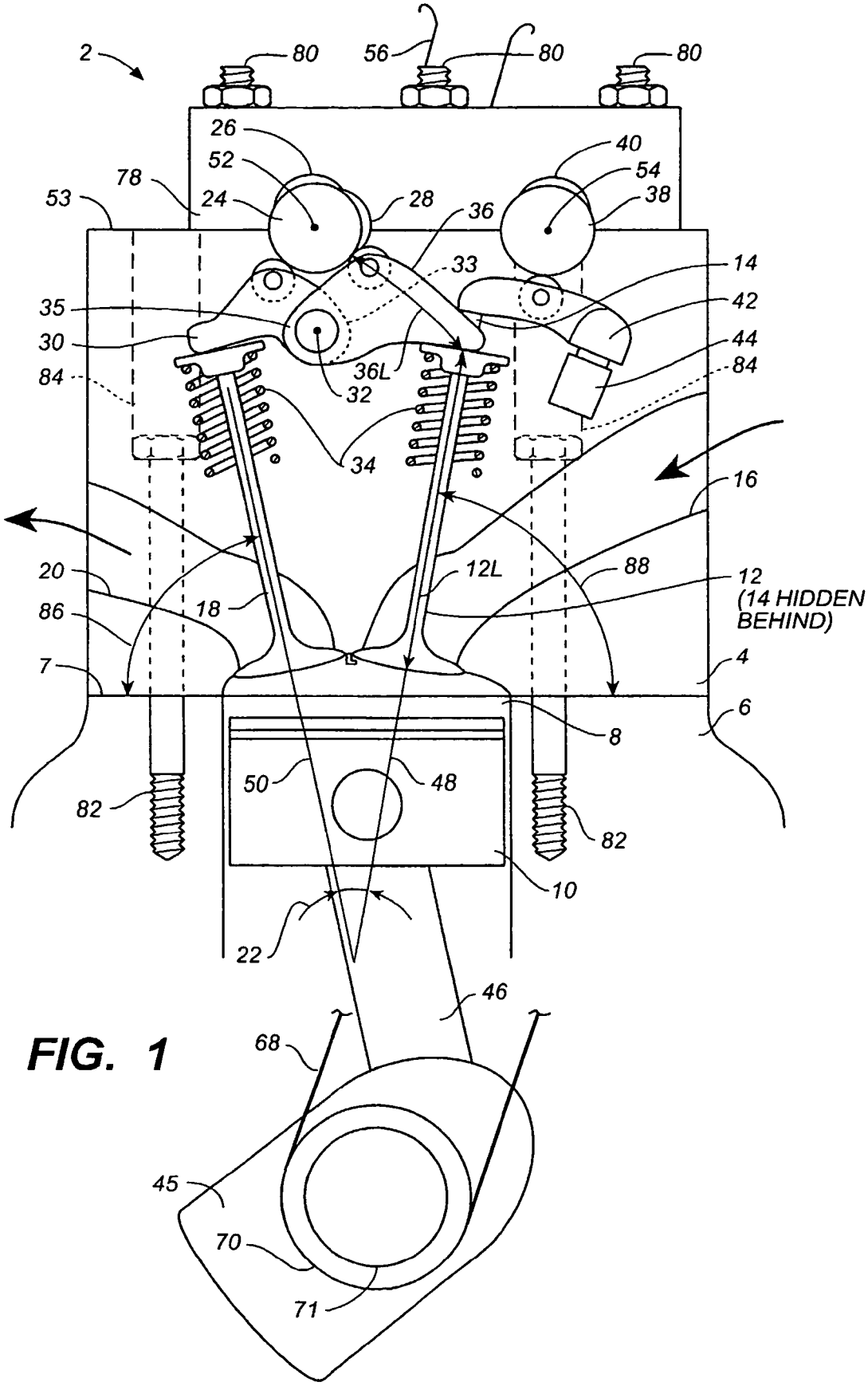
FIG. 1 is a sectional front view illustration of the present invention with a shaft mounted first intake rocker, a shaft mounted exhaust rocker, and a first camshaft centrally located between the rockers.
Figure 2:
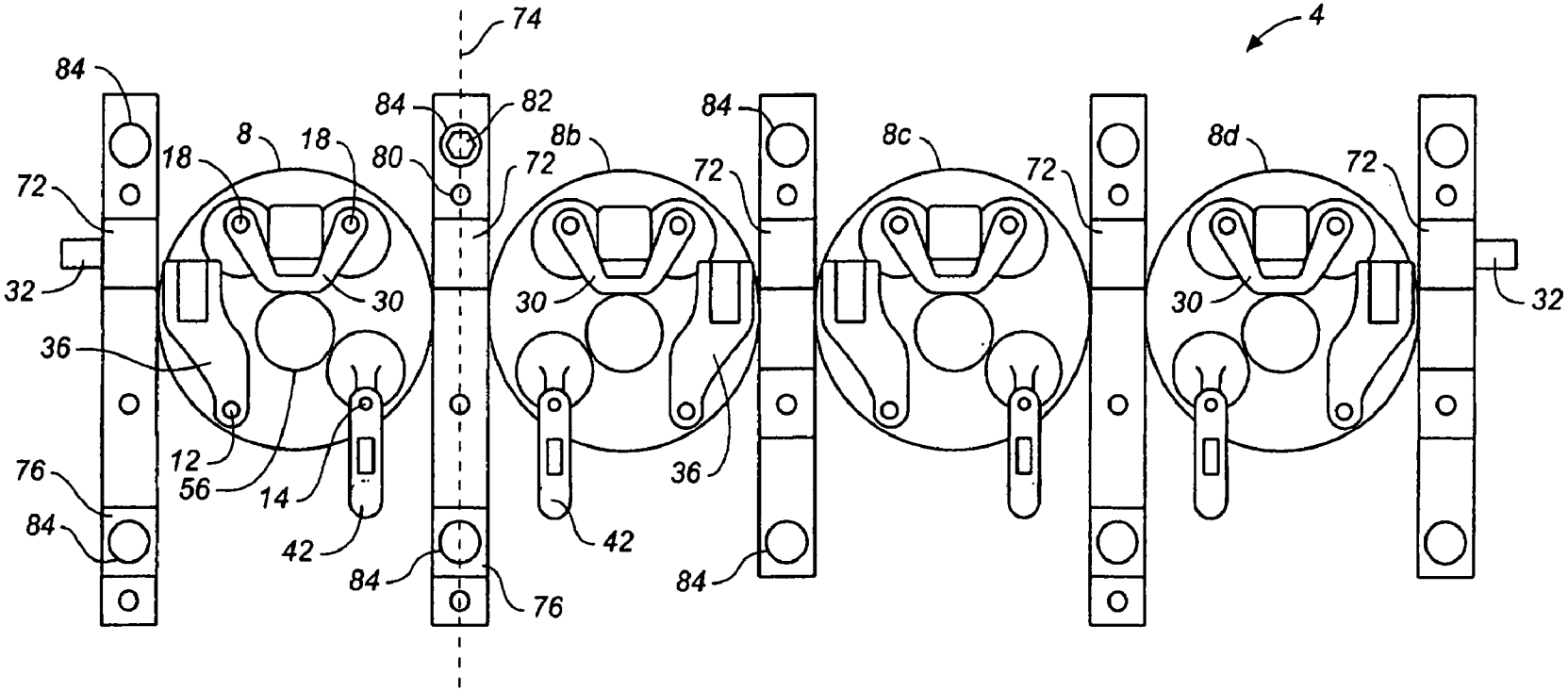
FIG. 2 is a top view illustration of the valve control apparatus and cylinder head shown in FIG. 1 for an inline 4-cylinder engine.
Figure 3:
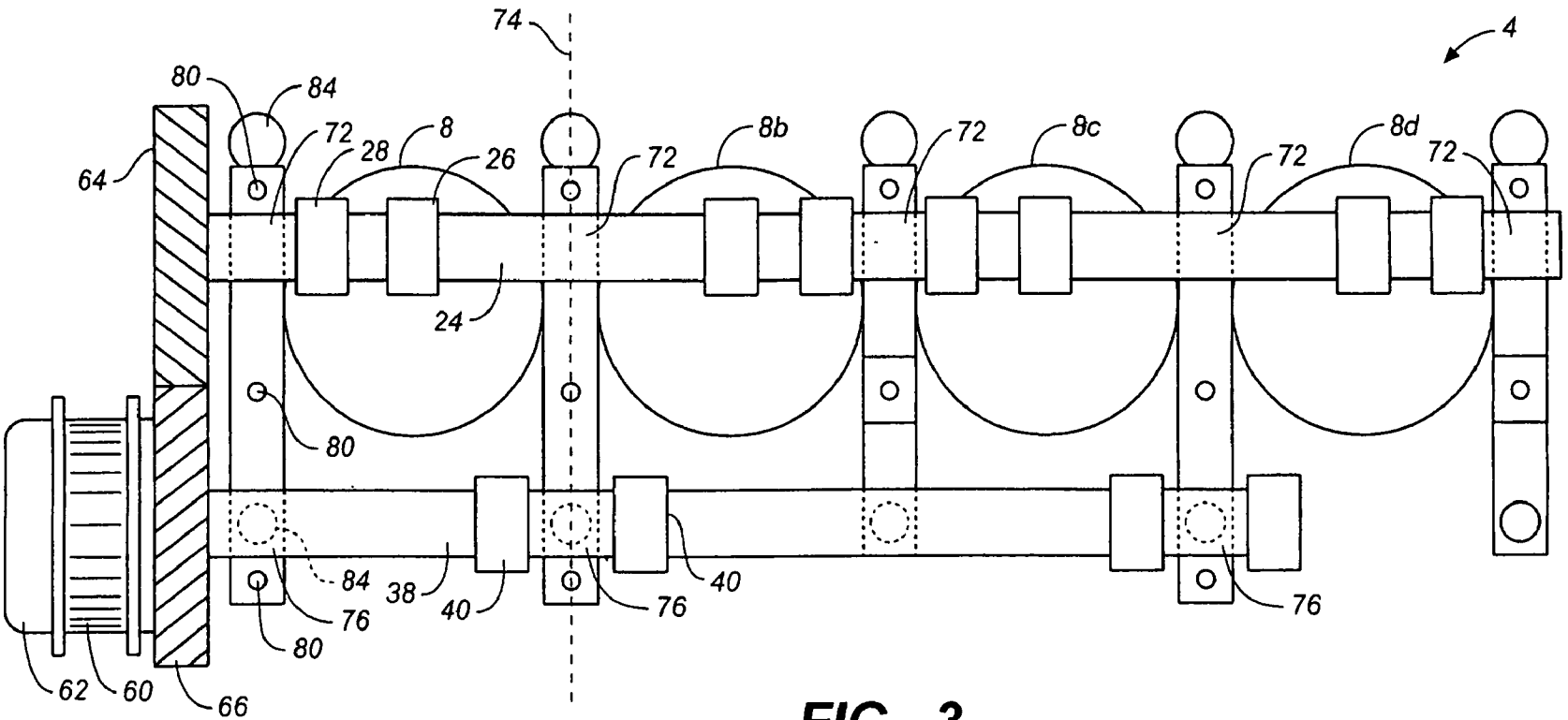
FIG. 3 is similar to FIG. 2, but shows the first and second camshafts, and not the valves and rockers for clarity.

FIGS. 1, 2 and 3 are intended to illustrate a portion of a valve control apparatus 2 according to the present invention. Valve control apparatus 2 is mounted in a cylinder head 4, cylinder head 4 being mounted on an engine block or cylinder housing 6 having a deck surface 7, a first cylinder 8 and a piston 10 slidably mounted in cylinder 8 for reciprocating motion. Reciprocating motion of piston 10 defines a piston line of action, piston line of action and deck surface 7 being generally perpendicular in the preferred embodiment of the present invention.

Cylinder head 4 has a first intake valve 12, a second intake valve 14 and at least one intake port 16 for flow of air or another fluid into cylinder head 4 and into first cylinder 8. Cylinder head 4 further has at least one and preferably two exhaust valves 18 and at least one exhaust port 20 for flow of exhaust or another fluid out of first cylinder 8 and out of cylinder head 4.

Cylinder head 4 further including one or more exhaust rockers 30, and a first camshaft 24, camshaft 24 being formed with at least a first cam 26 and a second cam 28 spaced along its length. Preferably exhaust rocker 30 is pivotally mounted on a rocker shaft 32, and bears on first cam 26 and on said two exhaust valves 18, where rotation of camshaft 24 and first cam 26 causes exhaust rocker 30 to pivot, causing exhaust valves 18 to translate towards piston 10, causing exhaust port 20 to open, permitting the outflow of exhaust gas from first cylinder 8. Cylinder head 4 further includes a return spring 34 for each exhaust valve 18 for closing of each exhaust valves 18 with further rotation of first camshaft 24 and first cam 26.

Cylinder head 4 further includes a first intake rocker 36 preferably mounted on rocker shaft 32. First intake rocker 36 bears on second cam 28 and on first intake valve 12, where rotation of camshaft 24 and second cam 28 causes first intake rocker 36 to pivot causing first intake valve 12 to translate towards piston 10 causing intake port 16 to open, permitting the inflow of air into first cylinder 8. Cylinder head 4 further includes another return spring 34 for closing of intake valves 12 with further rotation of first camshaft 24 and second cam 28.

Cylinder head 4 further including a second camshaft 38, second camshaft 38 having a third cam 40, and a second intake rocker 42. Second intake rocker 42 is preferably pivotally mounted on a pedestal 44, and bears on third cam 40 and on second intake valve 14, where rotation of second camshaft 38 and third cam 40 causes second intake rocker 42 to pivot, causing second intake valves 14 to translate towards piston 10, causing intake port 16 to open, permitting the inflow of air or another fluid into first cylinder 8. Cylinder head 4 further includes another return spring 34 for second intake valve 14 for closing of intake valves 14 with further rotation of first camshaft 38 and third cam 40.

According to the preferred embodiment of the present invention, the amount of intake air trapped in cylinder 8 is adjusted by adjusting the phase relationship of second camshafts 38 relative to the crankshaft of the reciprocating piston machine, and/or relative to first camshaft 24, for adjusting the power output of the engine, it further being understood that fuel may be mixed with the air before the air enters cylinder 8 or after the air enters cylinder 8. Referring now to FIGS. 1 and 3, cylinder head 4 has a phase shifter 62 for adjusting the phase relationship of second camshaft 38 relative to the crankshaft of the engine and/or first camshaft 24.

The valve control apparatus according to the present invention may be used for a reciprocating piston machines where control of flow into and/or out of a cylinder is desired, such as in a compressor or internal combustion engine. The principal intended application of the present invention is poppet valve control in a spark-ignition internal combustion engine having at least one cylinder 8, the cylinder being mounted in engine block or cylinder housing 6, and having piston 10 mounted for reciprocating movement in the cylinder, and a crankshaft 45, and a connecting rod 46 connecting piston 10 to crankshaft 45. The present invention may be employed in inline engines such as I-2, I-3, I-4, I-5, and I-6 engines, as well as V engines such as V6 and V8 engines, as well as other engine and non engine applications. Cylinder head 4 includes first intake valve 12 and second intake valve 14 associated with cylinder 8 for control of the flow of air, air mixed with fuel, or another fluid into cylinder 8, and exhaust valve(s) 18 for control of the flow of exhaust products or another fluid out of cylinder 8. First intake valve 12 has an intake valve line of action 48, and exhaust valve 18 has an exhaust valve line of action 50. Valve included angle 22 being the separation angle between intake valve line of action 48 and exhaust valve line of action 50. Valve included angle 22 also defines a quadrant within the cylinder head, where the location of parts may be specified as being either inside the valve included angle or outside of the valve included angle. First camshaft 24 preferably opens all of the exhaust valves 18 per cylinder and opens first intake valves 12 per cylinder, first camshaft 24 having a first camshaft axis of rotation 52. Second camshaft 38 opens second intake valve 14.

In the preferred embodiment of the present invention second camshaft 38 includes a drive pulley 60 (shown in FIG. 3) and a phase shifter 62 for adjusting the phase relationship between drive pulley 60 and second camshaft 38. A driven gear 64 is attached to first camshaft 24, and a drive gear 66 is attached to drive pulley 60, gears 64 and 66 being in mesh. Drive pulley 60 is preferably driven by a chain or belt 68 (shown in FIG. 1), belt 68 being driven by a crank sprocket or pulley 70 mounted on crankshaft 71 or on another shaft that rotates at a constant gear ratio relative to the crankshaft. Accordingly, belt 68 drives pulley 60 turning drive gear 66, drive gear 66 in turn driving driven gear 64 and turning first camshaft 24. Pulley 60 turns second camshaft 38 acting through phase shifter 62. Those skilled in the art will appreciate that other functional means may be employed to drive first camshaft 24 and second camshaft 38, and to adjust the phase relationship between first camshaft 24 and second camshaft 38.

In general terms, a first drive means is provided for driving first camshaft 24, the first drive means being driven by said crankshaft, optionally through gears belts, and/or chain(s), and a second drive means is provided for driving second camshaft 38, the second drive means includes a phase shifter for adjusting the phase relationship of second camshaft 38 to first camshaft 24 for adjusting the phase relationship of the opening of first intake valve 12 relative to the opening of second intake valvel 4, for controlling fluid flow into the reciprocating piston machine through intake port 16.

First intake valve 12 is associated with first intake rocker 36 having a first intake rocker mount 33, and first intake rocker 36 is driven by first camshaft 24. Cylinder head 4 further has one or more exhaust rockers 30, each of the exhaust rockers having an exhaust rocker mount 35 for pivotal support of the rocker in the cylinder head. Exhaust rocker mount 35 and first intake rocker mount 33 may be separate mounts, or a combined mount such as a common shaft mount (shown), where rocker shaft 32 supports exhaust rocker 30 and first intake rocker 36. The first camshaft axis of rotation 52 is located within valve included angle 22, thereby providing a short intake rocker 36 and a short exhaust rocker 30, thereby providing low inertia intake and exhaust rockers having a low friction level and a high operational speed capability. The phase between first intake valve 12 and second intake valve 14 is adjusted for controlling fluid flow into said reciprocating piston machine.

Preferably exhaust rocker mount 35 is located between valve included angle 22, and first intake valve rocker mount 33 is located between valve included angle 22, and first camshaft 24 is located generally on the far side of exhaust rocker 30 from piston 10, thereby providing space for a spark tube 56 between the intake and exhaust valves, while also providing a narrow valve included angle 22, and a light-weight exhaust rocker 30 first intake rocker 36 providing a high operational speed and a compact cylinder head size. Additionally, first camshaft 24 is preferably located generally on the far side of exhaust rocker 30 and generally on the far side of first intake rocker 36 from piston 10 for location of the rocker pivots at a greater distance from their associated valves for minimizing scrubbing between the rockers and the valve stems, and in more detail, the cam followers (optional roller followers shown) of the intake and exhaust rockers are preferably located between the valve ends and the rocker pivots. Preferably spark tube 56 is located between first camshaft 24 and return springs 34 associated with intake valves 12 and 14.

Preferably cylinder head 4 includes two exhaust valves 18 per cylinder 8 and exhaust rocker 30 comprises a single exhaust rocker for actuation of the two exhaust valves per cylinder, thereby providing space within the cylinder head for the first intake valve rocker mount 33 and spark tube 56 within a small valve included angle 22.

Rocker shaft 32 or another type rocker shaft may be used for supporting the exhaust rockers and/or the first intake rocker 36. Alternatively, the rockers may have a pedestal mount with an arrangement similar to pedestal mount 44, or the rockers may have another type of functional rocker mount. As described previously, first intake rocker mount 33 may be a shaft type mount (shown), and exhaust rocker mount 35 may also be a shaft type mount (shown), and exhaust rockers 30 and first intake rocker 36 may both be mounted on rocker shaft 32. Referring now to FIGS. 1 and 2, according to the preferred embodiment of the present invention, cylinder head 4 has a single rocker shaft 32 for supporting all of the exhaust rockers and all of the first intake valve rockers 36 for two or more inline cylinders. The rocker mount shaft preferably has a slide fit into cylinder head 4 for assembly of the rockers of at least two of said cylinders on rocker shaft 32. The single rocker shaft bore can be drilled at low cost, and the single rocker shaft provides low cost assembly and precision alignment of the rockers from one cylinder to the next. The single rocker shaft for multiple cylinders further occupies a small space, as removable caps are not required to secure the rocker shaft from cylinder to cylinder. The small space requirement of the rocker shaft according to the present invention is valuable for freeing up space for other cylinder head parts, such as the valve springs, in turn permitting a narrower valve included angle to be employed.

Referring now to FIGS. 1 and 2, second camshaft 38 has a second camshaft axis of rotation 54, second camshaft axis of rotation 54 preferably being located outside of valve included angle 22, thereby providing space within cylinder head 4 for first intake valve rocker mount 33 and the one or more exhaust rocker mounts 35.

Spark tube 56, exhaust rocker mount(s) 35, and first intake rocker mount 33 are preferably located within valve included angle 22, and preferably valve included angle 22 has a value less than 32 degrees, thereby providing light weight exhaust and intake rockers having low friction and a high operational speed capability.

Figure 4:
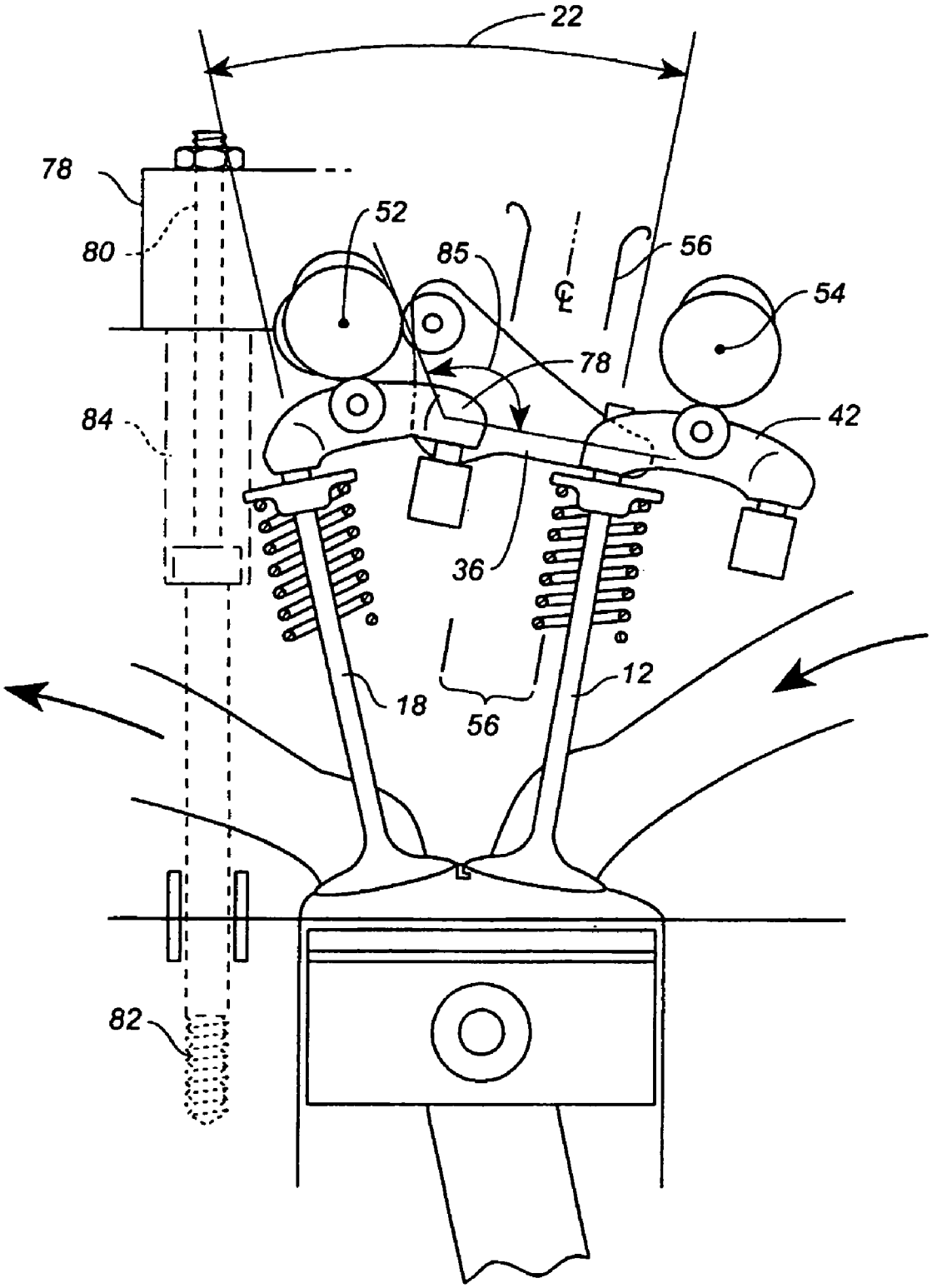
FIG. 4 is similar to FIG. 1, but shows roller finger followers for the exhaust valves, and cylinder head fasteners generally concentric with the camshaft bearing cap fasteners.

First intake valve 12 has an overall intake valve length 12L, and first intake valve rocker 36 has a first rocker length 36L measured from valve 12 to the cam contact point of first intake rocker 36 with the first intake camshaft 24. Preferably rocker length 36L is no more than 90 percent as long as first intake valve length 12L, for providing a light-weight intake rocker having low friction and a high operational speed. First intake valve rocker 36 has a first contact point with first camshaft 24 and a second contact point with first intake valve 12. Preferably the first contact point is generally between the second contact point and the pivot axis of first intake valve rocker 36, for providing a light-weight rocker and a rocker mount location spaced apart from the spark tube, and importantly for also providing a long distance between the rocker pivot axis and intake valve 12 for minimizing scuffing between the rocker and valve, it being understood that the end of the rocker may optionally include a roller. Those skilled in the art will appreciate that rollers are preferred but optional for contact between the rockers and cam lobes. In any event, the distance from the second contact point to the pivot axis of first intake valve rocker 36 is preferably greater 70 percent of the distance from the first contact point to the second contact point. Referring now to FIG. 4, a first imaginary line between the first contact point and the pivot axis of first intake valve rocker 36 is separated from a second imaginary line between the second contact point and the pivot axis of first intake valve rocker 36 by an angle 85. Preferably angle 85 is less than 140 degrees, and optimally less than 90 degrees in order to provide a rigid rocker and a compact cylinder head.

Referring now to FIGS. 1 though 3 preferably engine block 6 includes a plurality of inline cylinders, including first cylinder 8, and optionally second cylinder 8*b*, third cylinder 8*c*, and fourth cylinder 8*d*, and cylinder head 4 includes a plurality of first camshaft bearings 72 for support of first camshaft 24. At least one of first camshaft bearings 72 is located on a bearing plane 74, bearing plane 74 being perpendicular to first camshaft axis of rotation 52 and passing approximately between first cylinder 8 and second cylinder 8*b*, (as opposed to passing through the centerline of cylinder 8 or 8*b*) thereby providing space within the cylinder head for the first intake valve rocker mount and one or more exhaust rocker mounts.

Preferably first intake rocker 36 is located on the far side of first cylinder 8 from second cylinder 8*b*, thereby providing space for the bearings, and providing a small bearing count and space for the rockers. Also preferably, one first camshaft bearing 72 is located between second cylinder 8*b* and third cylinder 8*c*, and second cylinder 8*b* has one first intake rocker 36 adjacent to third cylinder 8*c*, and third cylinder 8*c* has one first intake rocker 36 adjacent to second cylinder 8*b*, thereby providing robust support of camshaft 24, a small bearing count, space for the rockers, and a compact cylinder head. Optionally, all of the intake rockers may have the same shape in order to reduce cost, rather than some being right handed and some being left handed, however, bearing count and friction may be increased.

Cylinder head 4 includes a plurality of second camshaft bearings 76 for support of second camshaft 38. Preferably, at least one of second camshaft bearings 76 is located approximately on bearing plane 74, and at least two of second intake rockers 42 straddle second camshaft bearing 76, thereby providing robust support of camshaft 38, a compact cylinder head with a low bearing count, and low friction levels. Camshaft bearings 72 and 76 may be formed in cylinder head 4, or be bearing inserted into cylinder head 4.

Cylinder head 4 may have inline first cylinder 8, second cylinder 8*b* and a third cylinder 8*c*, further having second intake camshaft 38 supported by at least one of second camshaft bearings 76 located between first cylinder 8 and second cylinder 8*b*, and by another second camshaft bearing 76 located on the far side of third cylinder 8*c* from second cylinder 8*b*, and preferably second camshaft 38 is supported by no more than one of second camshaft bearings 76 per cylinder, and in the preferred embodiment of the present invention, second camshaft 38 is supported by a fewer number ofjournal bearings than number of cylinders in engine block 6.

FIG. 4 is similar to FIG. 1, except that FIG. 4 shows individual exhaust valve rockers 78 for each exhaust valve 18. Exhaust rocker 78 may be a pedestal mounted roller finger follower type rocker (shown), a shaft mounted rocker, or another functional type of rocker. Camshaft bearings for the first camshaft may optionally be placed between the two exhaust rockers 78 of cylinder 8 instead of between the cylinders. Spark tube 56 is located between intake valve 12 and first camshaft axis of rotation 52, to providing a compact cylinder head. Preferably second camshaft axis of rotation 54 is located outside of valve included angle 22, for providing space within the cylinder head for the first intake valve rocker mount and the exhaust rocker mounts.

Referring now to FIGS. 1 through 3, first camshaft 24 is supported by a plurality of first camshaft bearings 72 in cylinder head 4, and a plurality of camshaft bearing caps 78. Cylinder head 4 includes a plurality of bearing cap fasteners 80 for removeably fastening each camshaft bearing cap 78 to cylinder head 4, and cylinder head 4 includes a plurality of cylinder head fasteners 82 for removably fastening cylinder head 4 to engine block or cylinder housing 6. Cylinder head fasteners 82 have a tool path clearance 84 for access to the fasteners for installation and removal of fasteners 82. According to the present invention, at least one of first camshaft bearings 72 is located on first bearing plane 74, bearing plane 74 being perpendicular to first camshaft axis of rotation 52 and passing approximately between first cylinder 8 and second cylinder 8*b*, and at least one of cylinder head fasteners 82 is located approximately on first bearing plane 74, cylinder head fastener 82 further being located on the same side of cylinders 8 as exhaust valves 18, and tool path clearance 84 is free and clear of the first camshaft bearing 72, thereby providing a camshaft bearing undisturbed by tool path 84 for robust and low friction support of first camshaft 24. Preferably tool path 84 is on the far side of adjacent camshaft bearing cap fastener 80 from camshaft bearing 72. Referring now to FIG. 4, optionally tool path 84 may be generally concentric with camshaft bearing cap fastener 80, and fasteners 80 and 82 may optionally be combined.

Figure 7:
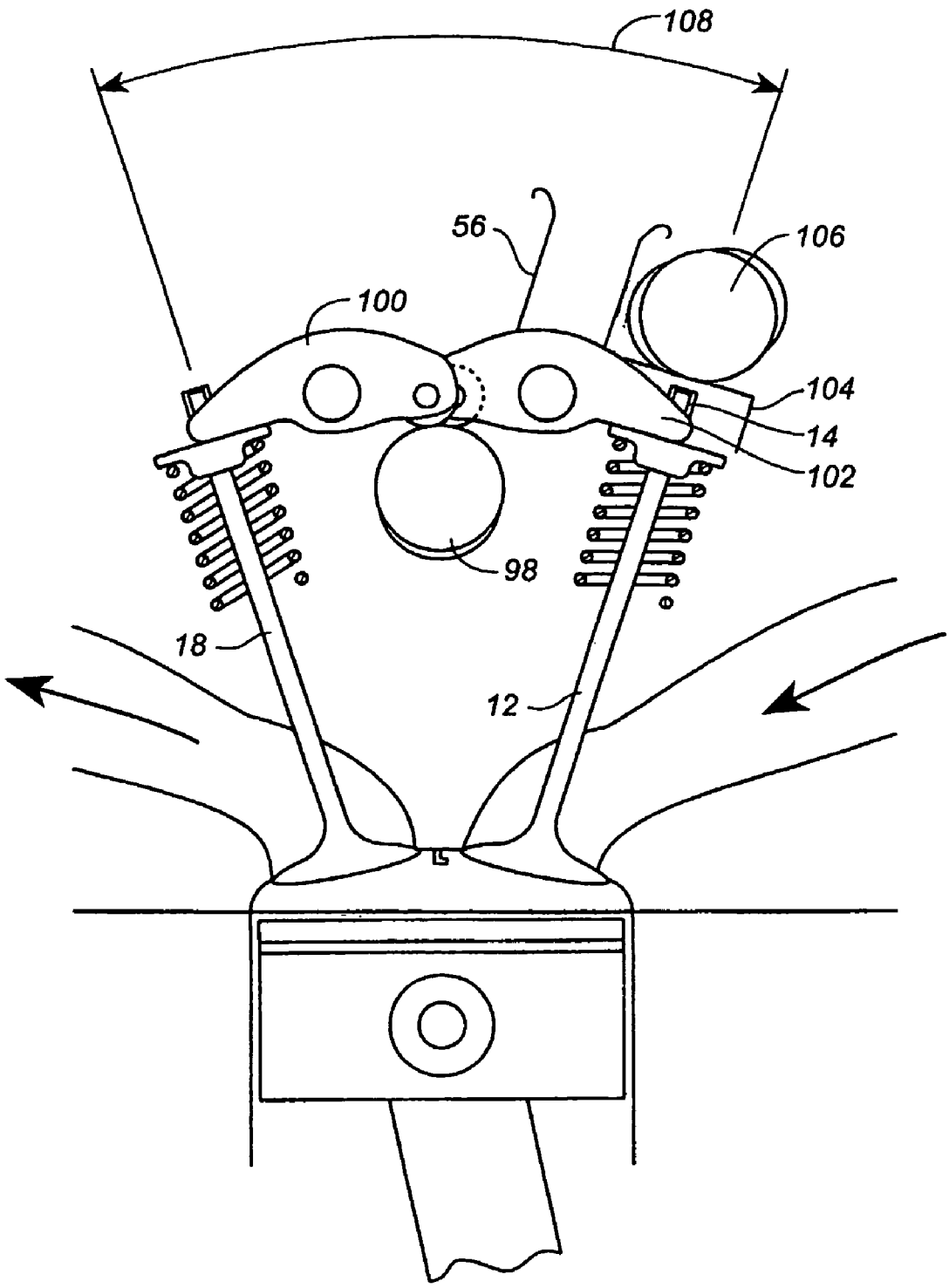
FIG. 7 is a front view illustration of a valve control apparatus according to the present invention having intake and exhaust rockers mounted over the first camshaft.

Referring now to FIGS. 1, 2 and 3, preferably a second one of cylinder head fasteners 82 is located underneath second camshaft 38. In more detail, another tool path 84 is generally centered under camshaft bearing 76 supporting second camshaft 38, and camshaft bearing cap fasteners 80 are located on either side of second camshaft 38. The hole in bearing 76 being acceptable due to the camshaft bearing load being mostly on the camshaft bearing cap 78 side of bearing 76. Optionally, tool path 84 may be located inboard or outboard of bearing 76 for second camshaft 38, where the tool path is free and clear of the bearing (not shown). FIG. 7 shows a direct attack bucket type tappet, having a second camshaft located above valve 12, providing space outboard of the second camshaft for tool path 84 (not shown).

Exhaust valve line of action 50 and deck 7 are separated by an exhaust valve angle 86, and intake valve line of action 48 and deck 7 are separated by an intake valve angle 88. Exhaust valve angle 86 is measured from deck 7 to exhaust valve line of action 50, valve included angle 22 is measured from exhaust valve line of action 50 to intake valve line of action 48, and intake valve angle 88 is measured from intake valve line of action 48 to deck 7, and exhaust valve angle plus valve included angle plus intake valve angle adds up to 180 degrees. Valve included angle 22 may optionally be tipped off center for providing space for one tool paths 84 free and clear of first camshaft 24 and associated bearings 72 (shown), and/or to provide on axis alignment for another tool path 84 generally on axis with second camshaft axis 54 (shown), and/or for another tool path 84 free and clear of second camshaft 38 and associated bearings 76 (not shown). Preferably exhaust valve angle 86 is greater than intake valve angle 88 thereby providing one tool path 84 free and clear of camshaft 24 and free and clear of bearing 72 associated with camshaft 24, and preferably providing another tool path 84 generally on axis with second camshaft axis 54.

First camshaft axis of rotation 52 and said second camshaft axis of rotation 54 define a first camshaft plane 53. Preferably second intake valve 14 is longer than first intake valve 12, thereby locating first camshaft plane 53 generally parallel with deck 7, thereby providing lower cost machining and assembly, and/or for providing a higher placement of pedestal 44 associated with intake rocker 42 for a more upright and streamlined intake port 16.

Figure 5:
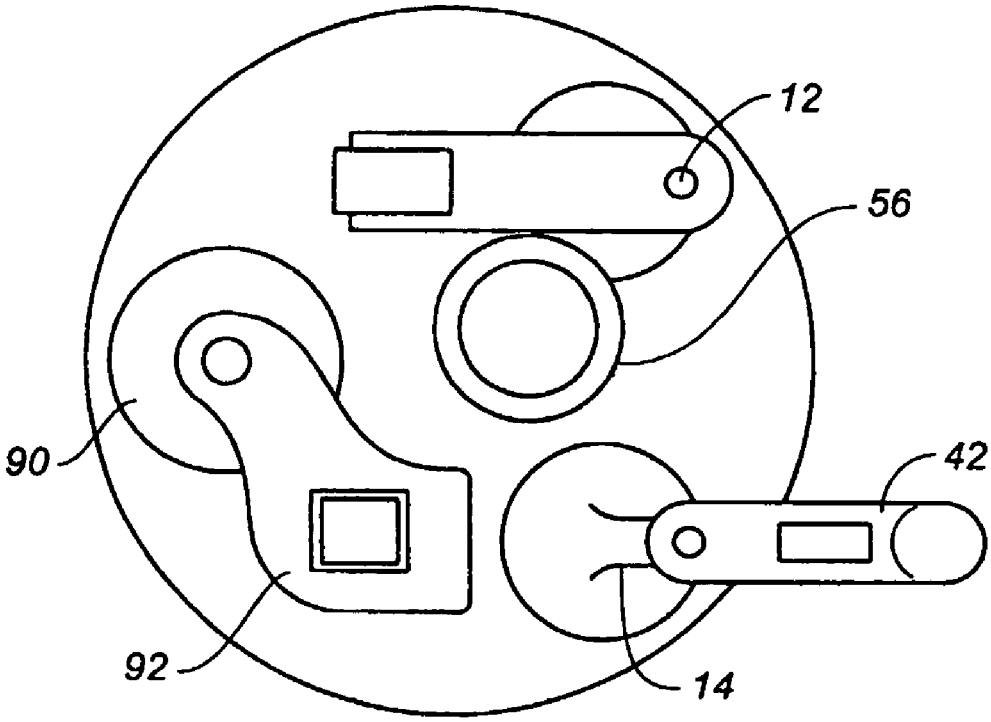
FIG. 5 is a top view illustration of a rocker arrangement for a 3-valve per cylinder engine having a shaft mounted exhaust valve rocker.
Figure 6:
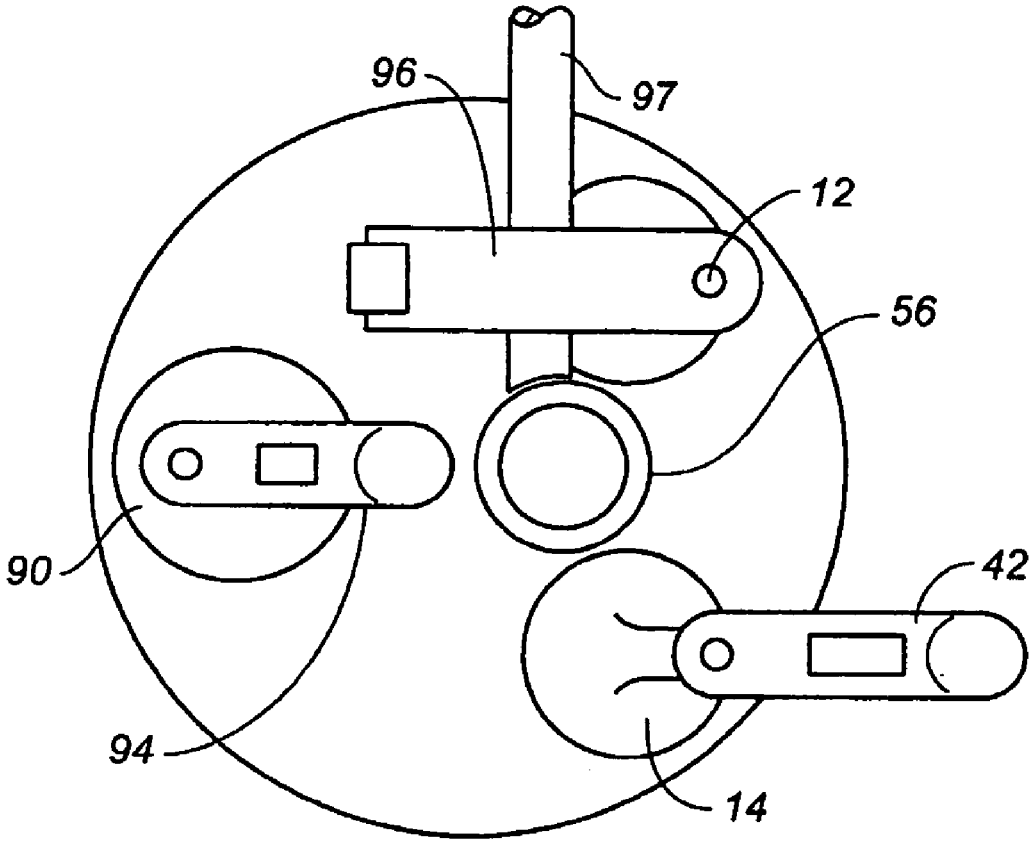
FIG. 6 is a top view illustration of a rocker arrangement for a 3-valve per cylinder engine having an exhaust finger follower type rocker.

Referring now to FIGS. 5 and 6, a single exhaust valve 90 may be used to provide for outflow of exhaust gas or another fluid from the cylinder, instead of the two exhaust valves 18 shown in FIGS. 1 and 2. FIG. 5 shows a shaft mounted exhaust rocker 92 associated with exhaust valve 90, and FIG. 6 shows a roller finger follower exhaust rocker 94 associated with exhaust valve 90. FIG. 6 also shows a shaft mounted intake rocker 96 associated with intake valve 12, intake rocker 96 being mounted on a rocker shaft 97. According to the present invention, spark tube 56 holds rocker shaft 97 in position.

FIG. 7 shows another embodiment of the present invention having a first camshaft 98 located generally below an exhaust rocker 100 and generally below an intake rocker 102, intake rocker 102 being associated with intake valve 12, valve included angle 108 being slightly larger than the preferred embodiment shown in FIG. 1. Intake valve 14 is actuated by a direct attack tappet 104 and a second camshaft 106. Intake valve 14 may alternatively be actuated by a finger follower rocker as shown in FIG. 1, a shaft mounted rocker, or another functional type rocker.

Figure 8:
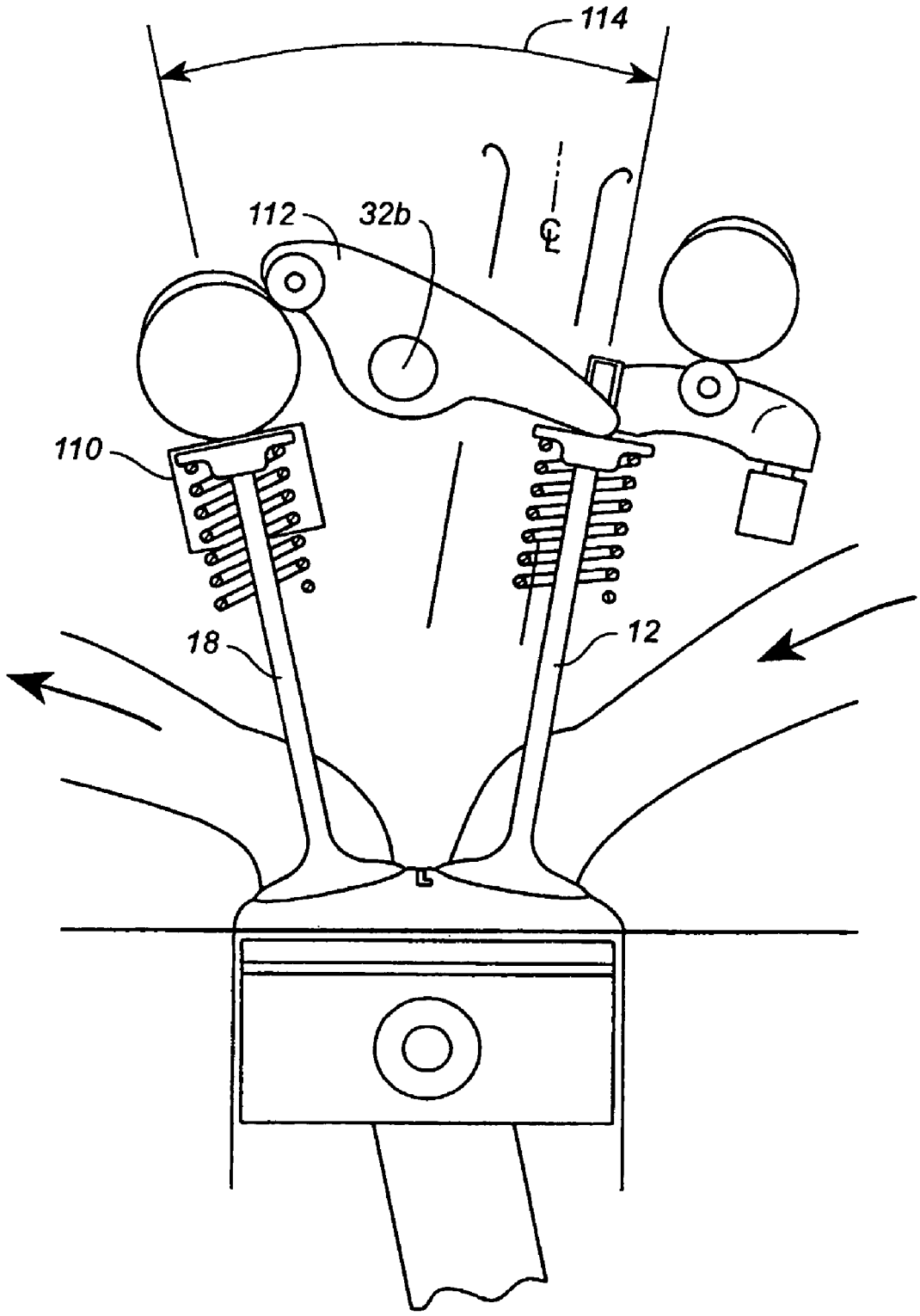
FIG. 8 is a front view illustration of a valve control apparatus having a full length slide through rocker shaft, a narrow valve included angle and a single intake rocker.

FIG. 8 shows another embodiment of the present invention having direct attack tappets 110 associated with exhaust valve 18. Camshaft bearings may optionally be placed between tappets 110. Intake valve 12 is associated with an intake rocker 112. Preferably valve included angle 114 is less than 32 degrees for providing a short span for intake rocker 112. Preferably a single rocker shaft 32*b* supports all of the first intake valve rockers 112 for two or more inline cylinders. The single rocker shaft bore can be drilled at low cost, and the single rocker shaft provides low cost assembly and precision alignment of the rockers from one cylinder to the next. The single rocker shaft for multiple cylinders further occupies a small space, as removable caps are not required to secure the rocker shaft from cylinder to cylinder. The small space requirement of the rocker shaft according to the present invention is valuable for freeing up space for other cylinder head parts, such as the valve springs and spark tube, in turn permitting a narrower valve included angle to be employed, and short first intake rockers to be used due to the narrow valve included angle.

Those skilled in the art will appreciate that the invention can be practiced within the spirit and scope of the claims.

What is claimed is:

1. A valve control apparatus for a reciprocating piston machine having at least one cylinder, said cylinder being mounted in a cylinder housing, a piston mounted for reciprocating movement in said cylinder, a crankshaft, and a connecting rod connecting said piston to said crankshaft, a cylinder head including a first and a second intake valve for each of said cylinders for control of fluid flow into each of said cylinders, and one or more exhaust valves for each of said cylinders for control of fluid flow out of said cylinders, said first intake valve having an intake valve line of action, and said exhaust valves having an exhaust valve line of action, and a valve included angle between said intake valve line of action and said exhaust valve line of action, a first camshaft for opening all of said exhaust valves per cylinder and for opening said first intake valves per cylinder, said first camshaft having a first camshaft axis of rotation, and a second camshaft for opening said second intake valves per cylinder, a first drive means for driving said first camshaft, said first drive means being driven by said crankshaft, and a second drive means for driving said second camshaft, said second drive means includes a phase shifter for adjusting the phase relationship of said second camshaft to said first camshaft for adjusting the phase relationship of the first intake valve opening relative to the second intake valve opening, for controlling fluid flow into said reciprocating piston machine, wherein said first intake valve further includes a first intake rocker having a first intake rocker mount, said first intake rocker being driven by said first camshaft, said cylinder head further having one or more exhaust rockers, each of said exhaust rockers having an exhaust rocker mount for pivotal support of the rocker in the cylinder head, wherein said first camshaft axis of rotation is located within said valve included angle, thereby providing a short intake rocker and one or more short exhaust rockers, thereby providing low inertia intake and exhaust rockers having a low friction level and a high operational speed capability, and an adjustable phase between the first intake valve and the second intake valve for controlling fluid flow into said reciprocating piston machine.

2. The valve control apparatus of claim 1, wherein said exhaust rocker mount is located between said valve included angle, and said first intake valve rocker mount is located between said valve included angle, and the first camshaft is generally on the far side of said one or more exhaust rockers from said piston, thereby providing a narrow valve included angle, and light weight rockers having a high operational speed and a compact cylinder head size.

3. The valve control apparatus of claim 1, wherein said cylinder head includes two exhaust valves per cylinder, and said one or more exhaust rockers comprises a single exhaust rocker for actuation of said two exhaust valves per cylinder, thereby providing space within the cylinder head for the first intake valve rocker mount.

4. The valve control apparatus of claim 2, further comprising a first rocker mount shaft, and said one or more exhaust rockers further being shaft mount, and said first intake rocker further being shaft mount, wherein said one or more exhaust rockers and said first intake rocker are both mounted on said first rocker mount shaft.

5. The valve control apparatus of claim 2, further including a plurality of inline cylinders, and a plurality of first camshaft bearings for support of said first camshaft, wherein at least one of said first camshaft bearings is located on a bearing plane, said bearing plane being perpendicular to said first camshaft axis of rotation and passing approximately between said cylinders, thereby providing space within the cylinder head for the first intake valve rocker mount and one or more exhaust rocker mounts.

6. The valve control apparatus of claim 1, further including a plurality of in-line cylinders, and a first rocker mount shaft, and said one or more exhaust rockers further being shaft mount, and said first intake rocker further being shaft mount, wherein said one or more exhaust rockers and said first intake rocker are both mounted on said first rocker mount shaft, wherein said first rocker mount shaft has a slide fit into said cylinder head for assembly of the rockers of at least two of said cylinders on said first rocker mount shaft.

7. The valve control apparatus of claim 1, wherein said second camshaft has a second camshaft axis of rotation, said second camshaft axis of rotation being located outside of said valve included angle, thereby providing space within the cylinder head for the first intake valve rocker mount and one or more exhaust rocker mounts.

8. The valve control apparatus of claim 1, further having a spark tube, wherein said spark tube, said one or more exhaust rocker mounts, and said first intake rocker mount are located within said valve included angle, wherein said valve included angle has a value less than 32 degrees, thereby providing light weight exhaust and intake rockers having low friction and a high operational speed.

9. The valve control apparatus of claim 1, further having a spark tube, wherein said spark tube, said one or more exhaust rocker mounts, and said first intake valve rocker mount are located within said valve included angle, wherein said first intake valves has an overall intake valve length, and said first intake rocker has a first rocker length measured from said first intake valve to the point of contact between said first intake rocker and said first camshaft, wherein said first rocker length is no more than 90 percent as long as said first intake valve length, thereby providing a light weight intake rocker having low friction and a high operational speed.

10. The valve control apparatus of claim 1, further having a spark tube, wherein said spark tube is located between said intake valves and said first camshaft axis of rotation, thereby providing a compact cylinder head.

11. The valve control apparatus of claim 1, further having a spark tube and individual exhaust valve rockers for each of said exhaust valves, and said second camshaft having a second camshaft axis of rotation, wherein said second camshaft axis of rotation is located outside of said valve included angle, thereby providing space within the cylinder head for the first intake valve rocker mount and the exhaust rocker mounts.

12. The valve control apparatus of claim 1, wherein said cylinder head includes one exhaust valves per cylinder and two intake valves per cylinder, thereby providing space within the cylinder head for the first intake valve rocker mount.

13. The valve control apparatus of claim 10, wherein said spark tube is located between said intake valves and first intake rocker mount.

14. The valve control apparatus of claim 1, wherein said first camshaft is located between said valve included angle, and said first camshaft is located generally between said exhaust rocker and said piston, and said first intake valve rocker mount is located between said valve included angle, thereby providing a narrow valve included angle, and light weight rockers having a high operational speed and a compact cylinder head size.

15. The valve control apparatus of claim 5, further having one or more second camshaft bearings for support of said second camshaft, wherein at least one of said second camshaft bearings is located approximately on said bearing plane, wherein at least two of said second intake rockers straddle said second camshaft bearing, thereby providing a compact cylinder head with a low bearing count and low friction levels.

16. The valve control apparatus of claim 15, further having inline at least a first cylinder, a second cylinder and a third cylinder, wherein said second intake camshaft is supported by at least one of said second camshaft bearing(s) located between said first cylinder and said second cylinder, and by a second camshaft bearing located on the far side of said third cylinder from said second cylinder, wherein said second camshaft is supported by no more than one of said second camshaft bearings per cylinder.

17. The valve control apparatus of claim 1, further having inline at least a first cylinder and second cylinder, wherein said first intake rocker is located on the far side of said first cylinder from said second cylinder, thereby providing space for the bearings, a small bearing count and space for the rockers.

18. The valve control apparatus of claim 17, further having inline a third cylinder and a forth cylinder, and a first camshaft bearing located between said second cylinder and said third cylinder wherein said second cylinder has a first intake rocker adjacent to said third cylinder, and said third cylinder has a first intake rocker adjacent to said second cylinder, thereby providing space for the bearings, a small bearing count, space for the rockers, and a compact cylinder head.

19. The valve control apparatus of claim 1, further including at least a first cylinder and a second cylinder, said first cylinder and said second cylinder being inline with one another and adjacent to one another, and, a plurality of first camshaft bearings for supporting said first camshaft in said cylinder head, a plurality of first camshaft bearing caps, and a plurality of bearing cap fasteners for removeably fastening each of said first camshaft bearing caps to said cylinder head, and a plurality of cylinder head fasteners for removably fastening said cylinder head to said cylinder housing, said cylinder head fasteners further having a tool path clearance for access to the fasteners for installation and removal of said fasteners, wherein a first one of said first camshaft bearings is located on a first bearing plane, said bearing plane being perpendicular to said first camshaft axis of rotation and passing approximately between said first cylinders and said second cylinder, wherein at least one of said cylinder head fasteners is located approximately on said first bearing plane, said cylinder head fastener further being located on the same side of said cylinders as said exhaust valves, wherein said tool path clearance is free and clear of said first one of said first camshaft bearings, thereby providing and integral camshaft bearing for robust and low friction support of said camshaft.

20. The valve control apparatus of claim 19, wherein said tool path is concentric with one of said camshaft bearing fasteners.

21. The valve control apparatus of claim 19, wherein said tool path is on the far side of said camshaft bearing fastener from said camshaft bearing.

22. The valve control apparatus of claim 1, further including at least a first cylinder and a second cylinder, said first cylinder and said second cylinder being inline with one another and adjacent to one another, and, a plurality of second camshaft bearings for supporting said second camshaft in said cylinder head, and a plurality of cylinder head fasteners for removably fastening said cylinder head to said cylinder housing, said cylinder head further having a plurality of tool paths for access to the cylinder head fasteners for installation and removal of said fasteners, wherein at least one of said tool paths intersects one of said second camshaft bearings, thereby providing a compact cylinder head layout.

23. The valve control apparatus of claim 1, further having a plurality of first camshaft bearings, and a plurality of cylinder head fasteners for removably fastening said cylinder head to said cylinder housing, said cylinder head further having a plurality of tool paths for access to the cylinder head fasteners for installation and removal of the fasteners, said cylinder housing having a deck, an exhaust valve angle measured from said exhaust valve line of action to said deck, and an intake valve angle measured from said intake valve line of action to said deck, wherein said exhaust valve angle is greater than said intake valve angle, and at least one of said first camshaft bearing is free and clear of said tool paths.

24. The valve control apparatus of claim 1, wherein said second intake valve is longer than said first intake valve, and said first camshaft axis of rotation and said second camshaft axis of rotation define a first camshaft plane, said first camshaft plane being approximately parallel to a deck, thereby providing a low cost of manufacture of said valve control apparatus, and providing space for a streamline intake port.

25. A valve control apparatus for an internal combustion engine having at least one cylinder, said cylinder being mounted in an engine block, a piston mounted for reciprocating movement in said cylinder, a crankshaft, and a connecting rod connecting said piston to said crankshaft, a cylinder head including a spark tube, a first and a second intake valve for each of said cylinders for control of fluid flow into each of said cylinders, and one or more exhaust valves for each of said cylinders for control of fluid flow out of said cylinders, said first intake valve having an intake valve line of action, and said exhaust valves having an exhaust valve line of action, and a valve included angle between said intake valve line of action and said exhaust valve line of action, a first camshaft for opening all of said exhaust valves per cylinder and for opening said first intake valves per cylinder, said first camshaft having a first camshaft axis of rotation, and a second camshaft for opening said second intake valves per cylinder, a first drive means for driving said first camshaft, and a second drive means for driving said second camshaft, said second drive means includes a phase shifter for adjusting the phase relationship of said second camshaft to said first camshaft for adjusting the phase relationship of the first intake valve opening relative to the second intake valve opening, for controlling fluid flow into said reciprocating piston machine, wherein said first intake valve further includes a first intake rocker having a first intake rocker mount, said first intake rocker being driven by said first camshaft, said first intake rocker mount including a pivot shaft, said spark tube being located between said first intake valves and said pivot shaft, thereby providing a short intake rocker having a high operational speed capability, and an adjustable phase between the first intake valve and the second intake valve for controlling power output of said internal combustion engine.

26. The valve control apparatus of claim 25, wherein said first intake valves has an overall intake valve length, and said first intake rocker has a first rocker length measured from said first intake valve to the point of contact between said first rocker and said first camshaft, wherein said first intake rocker length is no more than 90 percent as long as said first intake valve length, thereby providing a light weight intake rocker having low friction and a high operational speed.

27. The valve control apparatus of claim 25, wherein said first intake valve has an overall intake valve length, and said first intake rocker has a first rocker length measured from the first intake valve to the point of contact with said first intake rocker with the said first intake camshaft, and said first rocker length is no more than 90 percent as long as first intake valve length thereby providing a light-weight intake rocker having low friction and a high operational speed.

28. The valve control apparatus of claim 25, wherein said first intake rocker has a pivot axis and a first contact point with said first camshaft and a second contact point with said first intake valve, said first contact point being generally between said second contact point and said pivot axis, thereby providing a light-weight rocker and a rocker mount location spaced apart from the spark tube.

29. The valve control apparatus of claim 28, wherein the distance from said second contact point to said pivot axis is greater 70 percent of the distance from said first contact point to said second contact point.

30. The valve control apparatus of claim 25, further having a first intake rocker pivot axis, a first contact point between and said first intake rocker and said first camshaft, a second contact point between said first intake valve and said first intake rocker, a first imaginary line between said first contact point and said pivot axis, a second imaginary line between said second contact point and said pivot axis, and a separation angle between said first imaginary line and said second imaginary line, said separation angle being less than 140 degrees thereby providing a rigid rocker and a compact cylinder head.

* * * * *